US006305291B1

(12) United States Patent
Karlsson et al.

(10) Patent No.: US 6,305,291 B1
(45) Date of Patent: Oct. 23, 2001

(54) SHOTGUN CARTRIDGE CASE-SLEEVE AND A CARTRIDGE MADE THEREFROM

(75) Inventors: Roland Karlsson, Borås; Konny Johansson, Brämhult, both of (SE)

(73) Assignee: Tomscot HB (SE)

( * ) Notice: Subject to any disclaimer, the term of this patent is extended or adjusted under 35 U.S.C. 154(b) by 0 days.

(21) Appl. No.: 09/403,409

(22) PCT Filed: Apr. 16, 1998

(86) PCT No.: PCT/SE98/00694

§ 371 Date: Feb. 4, 2000

§ 102(e) Date: Feb. 4, 2000

(87) PCT Pub. No.: WO98/48238

PCT Pub. Date: Oct. 29, 1998

(30) Foreign Application Priority Data

Apr. 21, 1997 (SE) ..... 9701471
Jul. 10, 1997 (SE) ..... 9702662

(51) Int. Cl.[7] ..... F42B 5/30
(52) U.S. Cl. ..... 102/466; 102/469
(58) Field of Search ..... 102/430, 448–467, 102/469, 470

(56) References Cited

U.S. PATENT DOCUMENTS

| | | | | |
|---|---|---|---|---|
| 3,088,405 | | 5/1963 | Clark, Jr. | 102/43 |
| 3,099,958 | | 8/1963 | Daubenspeck et al. | 102/42 |
| 3,298,313 | * | 1/1967 | Comerford | 102/451 |
| 3,550,531 | | 12/1970 | Carter | 102/42 |
| 3,760,729 | | 9/1973 | Freeman | 102/32 |
| 4,233,903 | | 11/1980 | Lage | 102/42 |
| 5,121,693 | | 6/1992 | Kosteck | 102/462 |

FOREIGN PATENT DOCUMENTS

| | | | | |
|---|---|---|---|---|
| 0 182 532 A1 | | 5/1986 | (EP) . | |
| 0 435 830 A1 | | 7/1991 | (EP) . | |
| 999458 | * | 1/1952 | (FR) | 102/469 |
| 1128191 | * | 1/1957 | (FR) | 102/469 |
| 1147004 | | 11/1957 | (FR) . | |
| 1094753 | | 4/1958 | (FR) . | |
| 700299 | * | 1/1966 | (IT) | 102/466 |
| 86/05871 | | 10/1986 | (WO) . | |

* cited by examiner

*Primary Examiner*—Harold J. Tudor
(74) *Attorney, Agent, or Firm*—Lerner, David, Littenberg, Krumholz & Mentlik, LLP

(57) ABSTRACT

Shotgun cartridge cases are disclosed which are produced from a unitary body of plastic material. The shotgun cartridge cases include a cylindrical wall with a based portion which includes a central opening adapted to receive a primer, and a number of grooves extending axially from the end plane of the cartridge case and defining displaceable regions of the base portion whereby these displaceable regions are axially displaceable by means of powder charge gases released by the cartridge. Shotgun cartridges are also disclosed.

23 Claims, 5 Drawing Sheets

SHOTGUN CARTRIDGE CASE-SLEEVE AND A CARTRIDGE MADE THEREFROM

FIELD OF THE INVENTION

The present invention relates to shotgun cartridge cases and to cartridges made therefrom.

BACKGROUND OF THE INVENTION

Cartridges for shotgun-shooting have been the subject of heated discussions among hunters and shooters for the last century. Theories relating to cartridge action vary from time to time, as do opinions on how a cartridge case and the components therein should be constructed.

Historically, the development of cartridge cases has progressed from brass cases, cardboard/metal-base cases, and plastic/metal-base cases to cases manufactured entirely from plastic.

With few exceptions, cases of the latter type have, however, remained on the drawing board.

The specific requirements for shotgun cartridge cases are particularly demanding. A utilisable case must be able to tolerate, for example, a gas pressure of up to 800 Bar. Its diameter should be such that it corresponds to nominal gun calibers of ±0.1 to 0.5 mm. After firing, the cartridge case should be easy to remove using an extractor or an ejector. Leakage of powder gas should be minimal. The case should be adaptable to all types of shotguns, including semi-automatic shotguns.

Naturally, the case must not rupture or leave residue in the gun, which could result in barrel rupture with catastrophic consequences.

The base of the cartridge case serves to form a shape-stable bottom with a seat for the primer. The base also forms the abutment plane against the gun's action body.

The case sleeve, particularly its front portion, should create as tight a seal as possible against the bore of the barrel under the influence of the gas pressure from the powder charge and the case sleeve should also be such that it can accommodate the required components, i. a. powder, wad and shot. The front portion of the case sleeve is advantageously such that it can be upset to thereby create a closure and hold the shot charge in place against the wad.

As is noted above, attempts have been made to manufacture shotgun cartridge cases entirely from plastic. It has been recognized that the material costs can thus be reduced and that manufacturing costs can also be lower since it allows for rational manufacturing methods. Furthermore, with regard to environmental and recycling aspects, there are advantages to be gained, particularly if it were possible to manufacture the shotgun cartridge case solely of a plastic material (mono-material).

One method for manufacturing shotgun cartridge cases of plastic which has been used on occasion is based on manufacturing the various parts of the cartridge case of mutually separate plastic materials. Thus, for the base, a stronger, i.e. more pressure-resilient, and more shape-permanent plastic material is selected than that used for the sleeve portion.

One example of this is shown in PCT Application No. WO 86/05871. So-called sequential injection molding is used in the manufacturing of the cartridge in which, in a first step, the sleeve portion is injected and, in connection thereto, in a second step the base portion is injected using a different plastic material than that of the sleeve portion. Furthermore, in this cartridge construction, the sleeve wall in the region of the charge and the primer is made so as to consist of two material layers which together provide a stable base.

Another example of manufacturing the base in a separate step using a different plastic material than that used for the sleeve body is shown in German Application No. 2,419,577. By a special design of the primer hole with three mutually different diameters, the intention here has been to reduce the risk of powder gas release through the primer hole to thereby reduce the risk of displacement of the primer.

An example of a case sleeve made from biaxially oriented plastic material, in an attempt to reduce the material thickness, is described in U.S. Pat. No. 5,121,693. The cartridge case in this example is provided with a traditional base made from metal.

In U.S. Pat. No. 3,760,729 there is disclosed a glass fiber reinforced plastic cartridge case. The case is explicitly designed to have a rigid base. There is a groove extending from the end plane of the base portion of the case.

The reasons for having the groove (the term used in the specification of said patent is "coring") are as follows:

1. to avoid uneven cooling and sinking of the molded case;
2. to avoid long molding cycles required by cooling of the thick base; and
3. to avoid physical weakness at the juncture of the thick base with the thin wall of the case. (See col. 4, lines 1–6).

The plastic cartridge case disclosed in U.S. Pat. No. 3,088,405 is also designed to have a rigid base in the embodiments shown in FIGS. 7,9, and 11, and the base of the cartridge is reinforced by a plurality of ribs. In col. 3, starting on line 49 it is stated: "by said ribs 38, tubular section 34 with counter pocket (probably means "primer pocket") 35 is interconnected with the wall of case 31 whereby a firm, rigid structure is provided having adequate support for the primer . . . ".

A shotgun cartridge case made in one piece from plastic is described in U.S. Pat. No. 3,550,531. According to the disclosure of that patent, the base portion is designed to be able to optimally convert powder gas energy into propulsive energy for the shot charge and to prevent the case from rupturing. The shaping of the base with weakened waist portions between an internal groove and external recesses does, however, imply that there is a large risk of the primer hole expanding such that powder gas is forced out between the primer and the wall of its hole. The primer can be displaced from its position and make it impossible to break the gun after firing.

It is therefore an object of the present invention to provide a shotgun cartridge case made completely of plastic, and shotgun cartridges made therefrom, in which the cartridge case is made in one piece by injection molding of a single plastic material (mono-material), and in which the base portion is shaped so that it meets current specification demands and functions at least as well as a traditional metal base.

SUMMARY OF THE INVENTION

In accordance with the present invention, these and other objects have now been realized by the invention of a shotgun cartridge case comprising a unitary body of plastic material including a cylindrical wall having an outer surface and an inner surface and a base portion defining an end plane and having an inner wall, the base portion including a central opening adapted to receive a primer, and a plurality of grooves extending axially from the end plane and defining a plurality of displaceable regions of the base portion, whereby the displaceable regions of the base portion are axially displaceable by means of powder charge gases released by the cartridge. Preferably, the plurality of grooves extend through a substantial portion of the base portion.

In accordance with one embodiment of the shotgun cartridge case of the present invention, the plurality of grooves includes a first groove comprising an inner circular groove proximate to the central opening thereby defining an inner material portion of the base portion between the first groove and the central opening and a second groove comprising an outer circular groove distal to the central opening thereby defining an outer material portion of the base portion between the second groove and the outer surface of the cylindrical wall. Preferably, the shotgun cartridge case includes an extractor rim extending radially outwardly from the outer material portion adjacent to the end plane.

In accordance with one embodiment of the shotgun cartridge case of the present invention, the case includes a plurality of third grooves extending radially within the base portion between the first groove and the second groove. In a preferred embodiment, the plurality of third grooves are equidistantly spaced from each other, whereby each of the plurality of displaceable regions of the base portion is formed by a pair of the third grooves, the first groove and the second groove.

In accordance with another embodiment of the shotgun cartridge case of the present invention, the case includes a plurality of radial inner webs and a plurality of radial outer webs, each of the plurality of displaceable regions being connected to the inner material portion and the outer material portion by at least one of the plurality of radial inner webs and at least one of the plurality of radial outer webs. In a preferred embodiment, the plurality of radial inner webs and the plurality of radial outer webs has a first thickness and the plurality of displaceable regions has a second thickness, the first thickness being substantially less than the second thickness. Preferably, the outer material portion and the inner material portion include an axial end surface, and the plurality of displaceable regions include axial end surfaces, and the axial end surfaces of the outer material portion, the inner material portion, and the plurality of displaceable regions are substantially planar and lie in a common radial plane.

In accordance with another embodiment of the shotgun cartridge case of the present invention, the base portion includes a maximum axial thickness and the plurality of grooves extend through the base portion a distance at least about two-thirds of the maximum axial thickness. In a preferred embodiment, the case includes a transition wall region connecting the inner wall of the base portion to the inner wall of the cylindrical wall, the transition wall region having a varying wall thickness whereby a conically tapering charge combustion chamber is provided facing the central opening.

In accordance with another embodiment of the shotgun cartridge case of the present invention, the inner material portion has a first radial thickness and the outer material portion has a second radial thickness, the first radial thickness being substantially greater than the second material thickness. In a preferred embodiment, the first radial thickness is at least two times the second radial thickness.

In accordance with another embodiment of the shotgun cartridge case of the present invention, the first groove has a first depth defining a first base wall and the second groove has a second depth defining a second base wall, the second depth being greater than the first depth whereby a line connecting the first base wall to the second base wall has a curvature substantially corresponding to the inner wall of the base portion, whereby the axial displacement of the plurality of displaceable regions is facilitated.

In accordance with another embodiment of the shotgun cartridge case of the present invention, the central opening in the base portion includes a first portion adjacent to the end plane having a first width and a second portion adjacent to the inner wall of the base portion having a second width, the second width being greater than the first width. In a preferred embodiment, the second width of the central opening defines an enlarged cylindrical surface in the central opening.

In accordance with another embodiment of the shotgun cartridge case of the present invention, the first portion of the central opening and the second portion of the central opening have substantially the same axial length.

In accordance with the present invention, a shotgun cartridge has also been invented comprising a unitary body of plastic material including a cylindrical wall having an outer surface, an inner surface, a first end and a second end, and a base portion at the first end of the cylindrical wall defining an end plane and having an inner wall, the base portion including a central opening adapted to receive a primer, the cartridge including an end closure at the second end of the cylindrical wall, a wad member disposed within the cartridge and spaced from the end closure and the base portion whereby the space between the end closure and the wad member is adapted to receive shot means and the space between the wad member and the base portion is adapted to receive a powder charge, and a plurality of grooves extending axially from the end plane and defining a plurality of displaceable regions of the base portion, whereby the plurality of displaceable regions of the base portion are axially displaceable by means of the powder charge gases released by the cartridge.

In accordance with a preferred embodiment of the shotgun cartridge of the present invention, the cartridge includes the primer disposed in the central opening, the primer including an outer surface for contacting the inner surface of the central opening, the outer surface of the primer including a pattern of recessed means.

In accordance with another embodiment of the shotgun cartridge of the present invention, the central opening in the base portion includes a first portion adjacent to the end plane having a first width and a second portion adjacent to the inner wall of the base portion having a second width, the second width being greater than the first width. Preferably, the cartridge includes adhesive means disposed within the second portion of the central opening for adhering the primer to the central opening. In a preferred embodiment, the second width of the central opening defines an enlarged cylindrical surface in the central opening.

In accordance with another embodiment of the shotgun cartridge of the present invention, the first portion of the central opening and the second portion of the central opening have substantially the same axial length.

BRIEF DESCRIPTION OF THE DRAWINGS

The present invention will be more readily understood by referring to the following detailed description which, in turn, refers to the attached drawings, in which.

DETAILED DESCRIPTION

Figure 1:
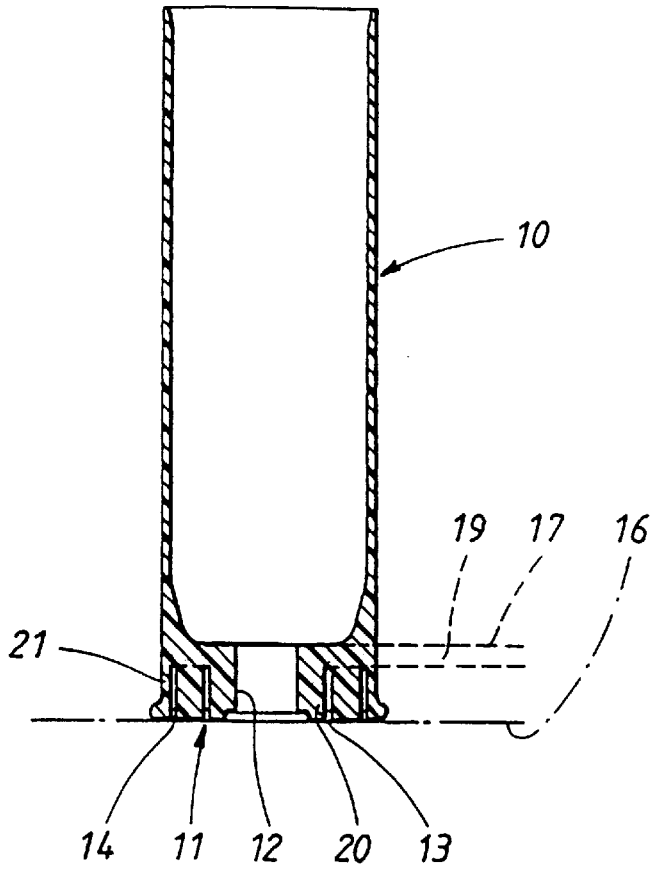
FIG. 1 is a side, elevational, cross-sectional view of a shotgun cartridge case according to a preferred embodiment of the present invention.

The shotgun cartridge case shown in FIG. 1 is manufactured in one piece by the injection molding of plastic material. In a preferred embodiment, the material is HD-polyethylene. The injection molding takes place in a multi-stage tool which is provided with means for core drawing or the like in order to make shaping as simple as possible. Measures have been taken in the mold to counteract shrinking of the plastic material, though at the same time this is done so that optimal material thicknesses can be used throughout the final product. The material thicknesses in question are, for example, cartridge case sleeve with about 1 to 2 mm thickness and the base portion in the axial direction being about 5 to 8 mm.

The cartridge case comprises a sleeve having a cylindrical wall 10 and a base portion 11 having an opening 12 intended to receive a primer.

The base portion 11 is provided with a pattern of grooves, i.e. an inner circular groove 13 around the primer hole 12 and a radially outer circular groove 14. Radial grooves 15 are connected to these circular grooves at peripherally equidistant distances. All of these grooves extend relatively deeply into the base portion from its end plane 16 and thus present considerable extensions in the axial direction of the cartridge case. The depth of the grooves in a preferred embodiment extends to at least ⅔ of the material thickness of the base portion 11, as represented by the distance between the dashed lines 16 and 17 in FIG. 1. Heels 18 are formed between the grooves, 13, 14 and 15, and are located peripherally equidistant from each other in the base portion 11.

Figure 10:
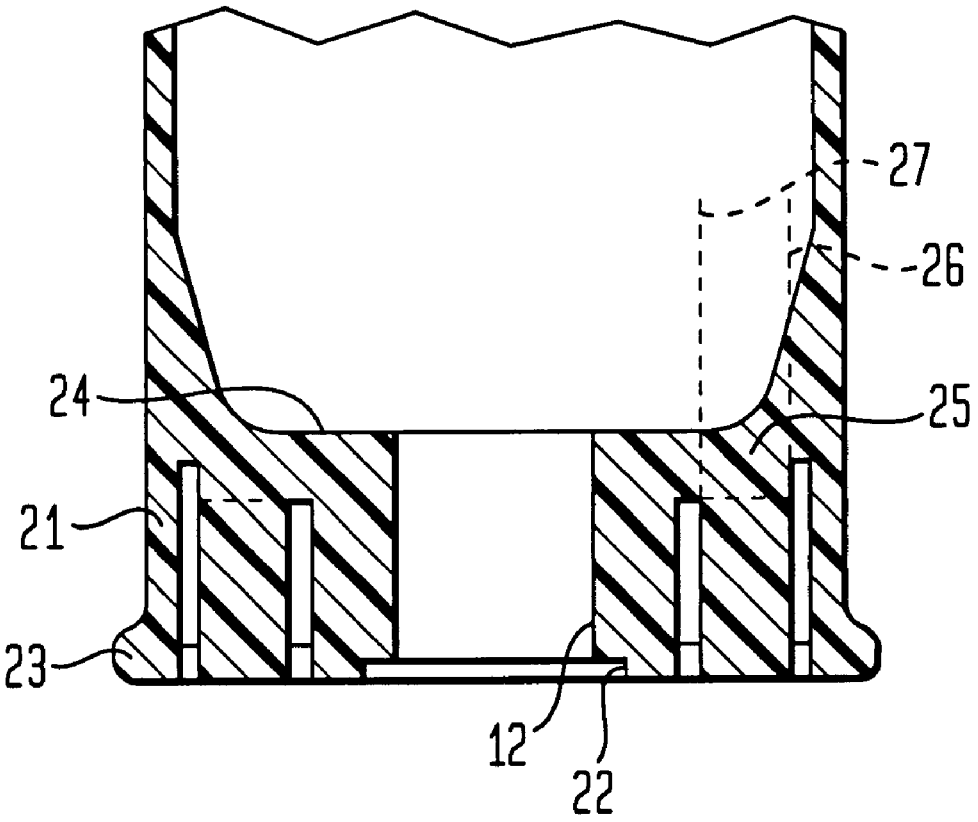
FIG. 10 is a partial, side, elevational, cross-sectional, enlarged view of another embodiment of a shotgun cartridge case according to the present invention.

The grooves, 13 and 14, in FIG. 1 have been shown as having the same depth, though it is also possible to provide the grooves with different depths, as shown in FIG. 10, so that the outer groove 14 extends somewhat further into the material in the base portion, to the level indicated by 19.

A first circumferentially extending material portion 20 is situated between the inner circular groove 13 and the primer hole 12, and this material portion has a radial material thickness which is greater than the radial material thickness of a radially outer material portion 21 which is delimited by the outer groove 14.

A seat 22 is formed in the end surface of the first material portion 20 for the rim of the primer. The hole 12 is dimensioned so that the primer can be fixedly held by the walls of the hole with a press fit. The radially outer material portion 21 terminates in an extractor rim 23. The material thickness in the radial direction of the circumferential material portion 20, as previously mentioned, is considerably thicker than the corresponding material thickness of the radially outer material portion 21. The purpose of the inner material portion 20 is to retain the primer in its proper place during the formation of powder gas and, for this purpose, the greatest possible radial material thickness should be used for the inner material portion 20. At the same time, the material thickness in the radial direction must not be too small for the outer circumferential material portion 21 since the extractor rim 23 must provide the necessary abutment strength for the gun's extractor after firing. Trials have shown that a ratio of at least about 2:1 between the material thicknesses of the inner material portion and the outer material portion is desirable.

Figure 2:
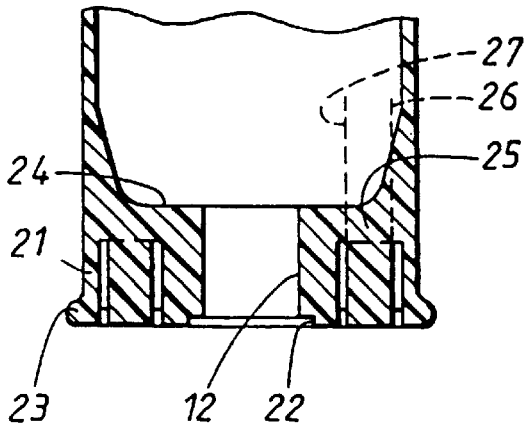
FIG. 2 is a partial, side, elevational, cross-sectional, enlarged view of the case shown in FIG. 1.

A circular waist portion 25 of reduced material thickness remains between the heels 18 and the powder charge base 24 between the dashed lines, 26 and 27 (FIG. 2). As a result of the particular symmetrical placement of the heels 18 and the sizing of the material thickness of the waist 25, as well as the material thickness in the given manner of the inner material portion 20, preconditions have been attained for controlled absorption of the gas pressure with retention of the primer in its proper location in the hole 12.

Figure 3:
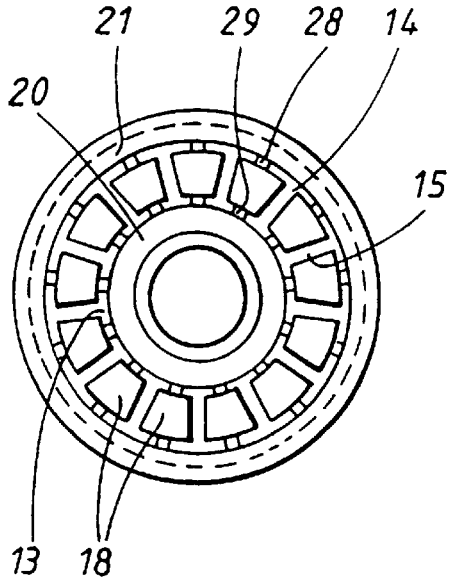
FIG. 3 is a bottom, elevational, plan view of the base portion of the case shown in FIG. 1.

The placement and guiding of the heels, both during manufacturing and during use, are further aided by arranging material webs, 28 and 29, with an axial length somewhat shorter than the depth of the groove in the shown embodiment, radially in respective groups, 13 and 14, and made in one piece with both the heels and the material portions, 20 and 21. The purpose of these webs, which have considerably less material thickness in the peripheral direction than the heels 18, is to stiffen the base portion, though still permitting the heels to perform their intended function. As a result of this dimensioning and placement of the material portions, the grooves, the heels and the webs, as well as the stated material thickness dimensioning, the embodiment of the base portion of the shotgun cartridge case shown in FIGS. 1–3 is particularly suited to tolerate the high gas pressure which arises during firing.

The gas pressure follows the law of least resistance and since the circumferential waist 25 and the heels 18 formed in one piece therewith is the weakest region seen from the powder charge, this will provide a translatory force acting axially towards the powder base 24 which elastically projects the heels 18 a short distance away from the bottom plane 16. The strain on the walls of the primer hole 12 will be minimal from this translatory force and the primer will be maintained in its engagement position against the walls of the hole.

The outer wall of the primer can also be provided with a suitable pattern of recesses, grooves or knurling.

When the primer is being press-fitted into the primer hole, the plastic material is enabled to "flow out" and form a friction-increasing arrangement with the pattern of recesses. In certain cases, and as previously mentioned, it can be advantageous to make the outer groove 14 deeper. This can be particularly advantageous when the powder combustion chamber has the curvature as shown in the drawing, whereby the material thickness in the waist 25 becomes more uniform along its entire radial width.

Figure 4:
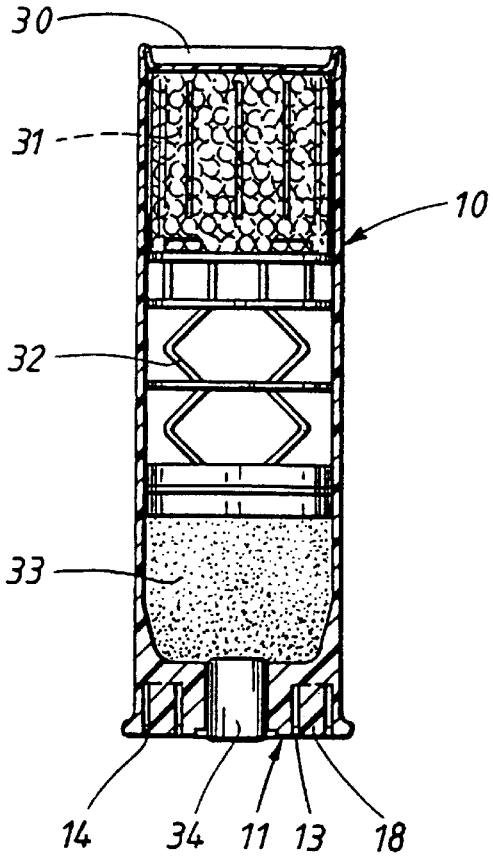
FIG. 4 is a side, elevational, cross-sectional view of the case in FIG. 1 in a sealed and charged condition with its constituent components therein.
Figure 5:
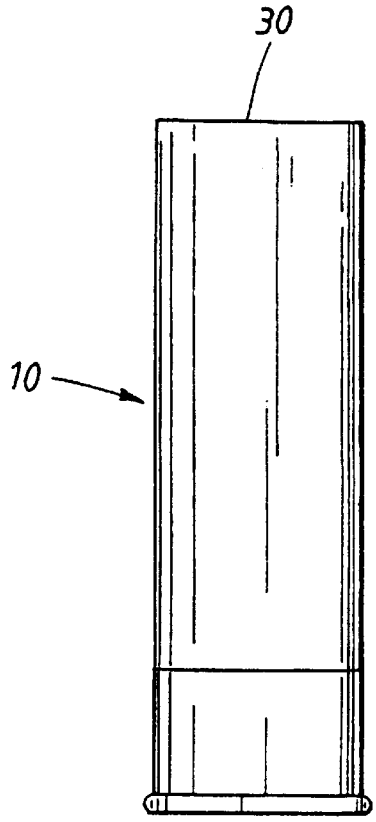
FIG. 5 is a side, elevational view of a shotgun cartridge case before its front portion is upset.

A shotgun cartridge case is shown in FIG. 4 according to the above-described embodiment, in a loaded condition. In the shown example, a top closure has been attained by upsetting the sleeve end 30 shown in FIG. 5. The upset end is placed above the shot charge 31 which is accommodated in a bowl of a known type of wad 32 which is provided with a bottom bowl to define a powder chamber 33 between the wad and the base portion of the case. A primer 34 is located in the primer hole 20.

Since the subject of the present invention, including the primer, is a mass-produced product, every change to constituent standard components naturally implies an increase in the cost of the end product. In certain applications, it is not justifiable to manufacture particular primers or subsequently machine standard primers, and there is thus a need for a more cost-effective solution to the problem of further securing the primer against displacement and leakage of powder gases.

Figure 6:
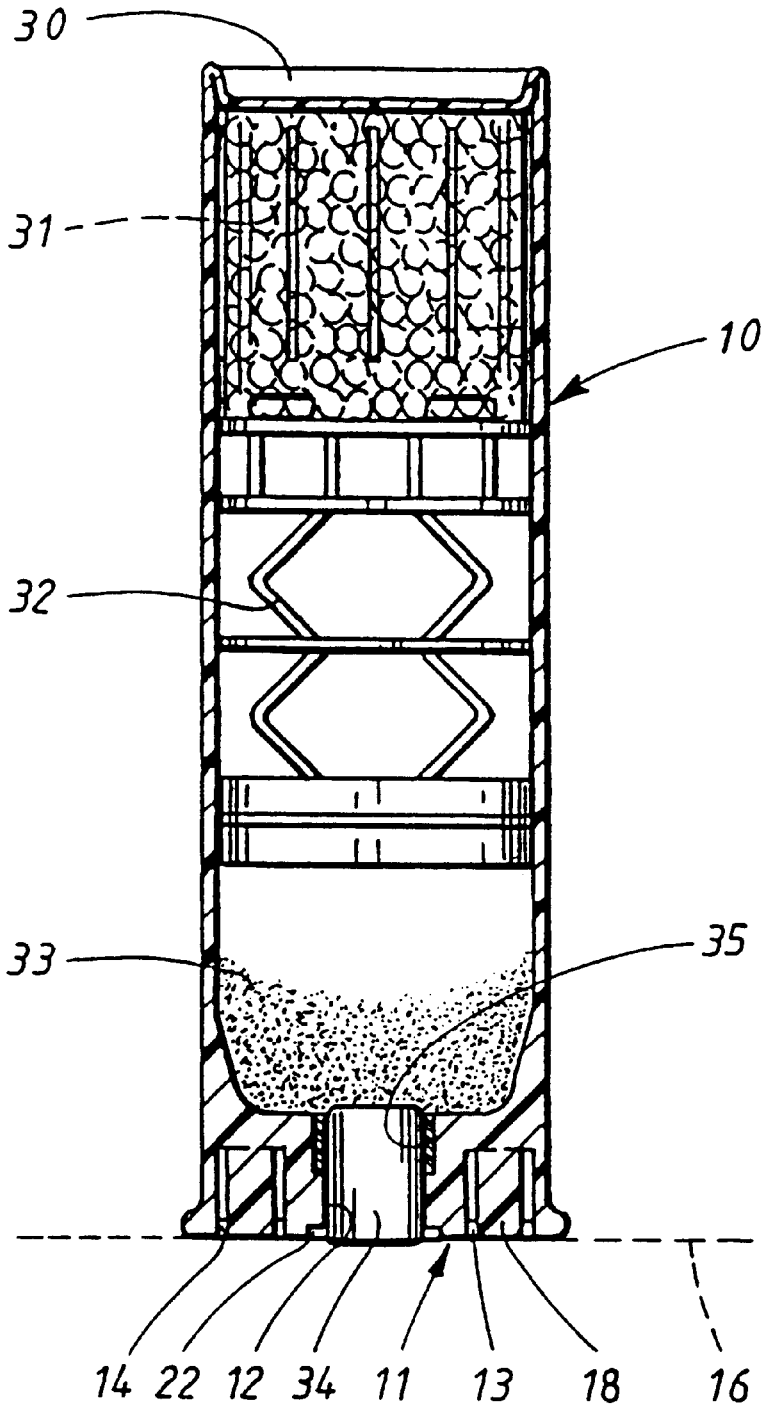
FIG. 6 is a side, elevational, cross-sectional view of a shotgun cartridge with an arrangement for ensuring the location of the primer.

Examples of such solutions are shown in FIGS. 6–9. In FIG. 6, a seat 22 for the rim of the primer is formed in the end surface of the base portion. The size of the hole 12 is such that the primer is insertable, preferably by a press fit, in the hole 12. At the end of the primer hole 12 facing the powder chamber 33, there is provided a circumferential widening 35, in the example in the form of an enlarged cylindrical portion of the primer hole 12 in the base portion. The extension in the axial direction for the enlarged cylindrical portion 35 is, in this embodiment, about half the length of the hole 12 which forms the opening for the primer 34.

Figure 7:
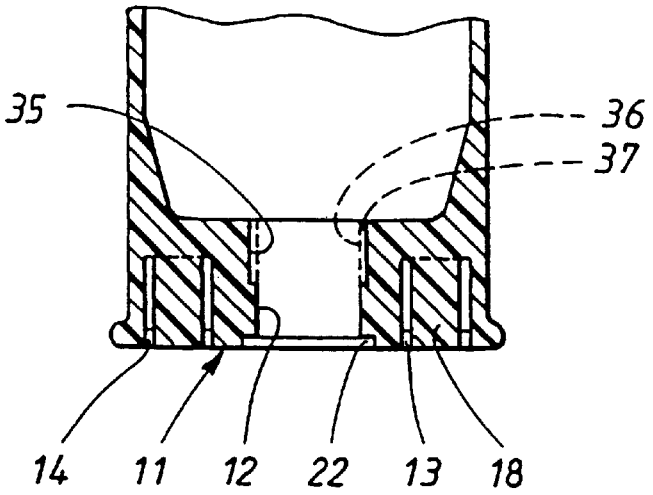
FIG. 7 is a partial, side, elevational, cross-sectional, enlarged view showing the base portion with the primer hole according to one embodiment of the present invention.
Figure 8:
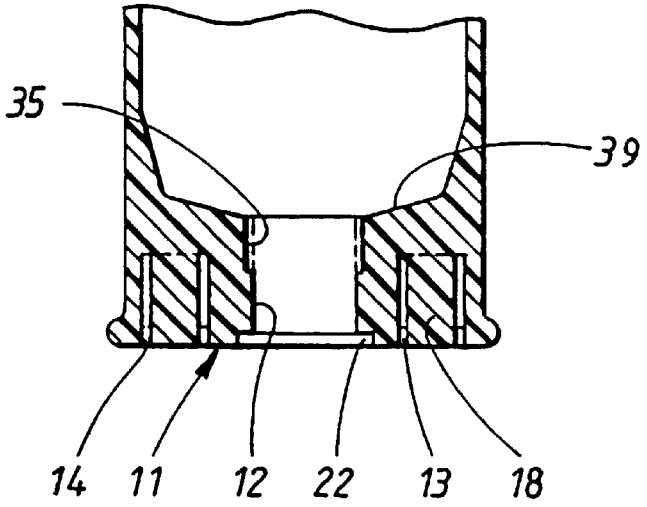
FIG. 8 is a partial, side, elevational, cross-sectional, enlarged view of the base portion with the primer hole and associated base parts in a modified embodiment of the present invention.

In FIG. 7, the arrangement of the widening 35 of the primer hole 12 is shown on a larger scale. The dashed lines 36 denote the extension of the hole 12 without the widening. Once a primer has been inserted, the widening 35 forms a distinct, well defined space in the base portion 11 between the outside of the primer and the delimiting side of the widening, i.e. concentric cylindrical sides defining a shaped cavity 37 in the shown example.

Figure 9:
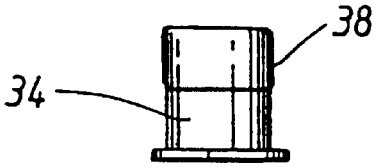
FIG. 9 is a schematic, side, elevational view of the primer with associated adhesion-increasing means removed from the seat in the base of either of the embodiments in FIGS. 7 and 8 hereof.

The shaped cavity 37 is intended to accommodate means which provide adhesion at least to the outside of the primer 34. As is known, the primer is made from metal, while the cartridge case is entirely manufactured from a monoplastic, for example HD-polyethylene. Means for achieving adhesion are present in many forms, including flowing forms. The choice of a suitable adhesion means/adhesive is made by initially taking into account its ability to achieve binding with the primer of metal, whereby this binding should be as strong as possible. Certain adhesion to the plastic in the base portion is of course advantageous if this can be achieved. The purpose of the adhesion-creating means in the shaped cavity or the gap 37 is to provide the primer with a peripheral collar 38 as shown in FIG. 9. This collar 38 is attained by injecting a liquid binder into the shaped cavity or the gap 37 after application of the primer in a conventional manner in the base portion 11 so that the binder hardens and forms the collar 38.

In order to attain the widening of the primer hole according to FIG. 7, the cylindrical primer hole 12 is suitably bored out to a depth corresponding to approximately half the material thickness, whereby the boring determines the delimiting wall of the widening 35. Alternatively, the special hole shaping can take place directly in connection with the injection molding, though this demands further measures when removing the cartridge case from the mold.

Since the means which create adhesion are preferably very fluid, a certain quantity of this means can seep into the region of the primer hole which is normally dimensioned to be a press fit against the primer. This can further improve locating of the primer.

Primarily, however, locating will be achieved with the collar 38, i.e. increase with a radial width of the shaped cavity, whereby the adhesion of the collar 38 to the primer will also determine the locating or retaining capability.

Even though only one type of widening for forming a collar has been shown, it will be realized that other shapes than the cylindrical shape are applicable even if, from a production point of view, cylindrical is presently optimal.

The adhesive means can also be applied so that the collar 38 at the top of FIG. 9 is given a peripheral brim which is entirely or partially adhesively fastened to the bottom of the powder chamber and forms further reinforcement of the fastening of the primer.

The described embodiments of the shotgun cartridge cases and cartridges hereof are presently the most preferred, though it is to be realized that there are possibilities of variation of the groove pattern in the base portion, though the basic idea is that the grooves will provide a translatory displacement of weakened regions in the base portion without the position of the primer being affected. In addition, the energy which is consumed when executing the translatory displacement will favorably contribute to reducing the stresses in the transition region between the base portion and the cartridge case sleeve, thereby avoiding rupture.

Even though mono-plastic material has been mentioned in the description, it is to be understood that it does not necessarily have to be a "pure plastic material". Instead, additions of fillers, for example chalk or the like, can be suitable if such material can otherwise fulfil the required demands.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A shotgun cartridge case comprising a body including a cylindrical wall having an outer surface and an inner surface and a base portion defining an end plane and having an inner wall, said entire cartridge case comprising a unitary one-piece body of plastic material, said base portion including a central opening adapted to receive a primer, and a plurality of grooves extending axially from said end plane, said plurality of grooves including radial groove means and circumferential groove means defining a plurality of displaceable regions of said base portion defined by both said radial groove means and said circumferential groove means, whereby said displaceable regions of said base portion are axially displaceable by means of powder charge gases released by said cartridge.

2. The shotgun cartridge case of claim 1 wherein said plurality of grooves extend through a substantial portion of said base portion.

3. The shotgun cartridge case of claim 1 wherein said circumferential groove means includes a first groove comprising an inner circular groove proximate to said central opening thereby defining an inner material portion of said base portion between said first groove and said central opening and a second groove comprising an outer circular groove distal to said central opening thereby defining an outer material portion of said base portion between said second groove and said outer surface of said cylindrical wall.

4. The shotgun cartridge case of claim 3 including an extractor rim extending radially outwardly from said outer material portion adjacent to said end plane.

5. The shotgun cartridge case of claim 3 wherein said radial groove means comprises a plurality of third grooves extending radially within said base portion between said first groove and said second groove.

6. The shotgun cartridge case of claim 5 wherein said plurality of third grooves are equidistantly spaced from each other, whereby each of said plurality of displaceable regions of said base portion is formed by a pair of said third grooves, said first groove and said second groove.

7. The shotgun cartridge case of claim 6 including a plurality of radial inner webs and a plurality of radial outer webs, each of said plurality of displaceable regions being connected to said inner material portion and said outer material portion by at least one of said plurality of radial inner webs and at least one of said plurality of radial outer webs.

8. The shotgun cartridge case of claim 7 wherein said plurality of radial inner webs and said plurality of radial outer webs has a first thickness and said plurality of displaceable regions has a second thickness, said first thickness being substantially less than said second thickness.

9. The shotgun cartridge case of claim 8 wherein said outer material portion and said inner material portion include an axial end surface, and said plurality of displaceable regions include axial end surfaces, and wherein said axial end surfaces of said outer material portion, said inner material portion, and said plurality of displaceable regions are substantially planar and lie in a common radial plane.

10. The shotgun cartridge case of claim 1 wherein said base portion includes a maximum axial thickness and said plurality of grooves extend through said base portion a distance at least about two-thirds of said maximum axial thickness.

11. The shotgun cartridge case of claim 10 including a transition wall region connecting said inner wall of said base portion to said inner wall of said cylindrical wall, said transition wall region having a varying wall thickness whereby a conically tapering charge combustion chamber is provided facing said central opening.

12. The shotgun cartridge case of claim 3 wherein said inner material portion has a first radial thickness and said outer material portion has a second radial thickness, said first radial thickness being substantially greater than said second material thickness.

13. The shotgun cartridge case of claim 12 wherein said first radial thickness is at least two times said second radial thickness.

14. The shotgun cartridge case of claim 12 wherein said first groove has a first depth defining a first base wall and said second groove has a second depth defining a second base wall, said second depth being greater than said first depth whereby a line connecting said first base wall to said second base wall has a curvature substantially corresponding to said inner wall of said base portion, whereby said axial displacement of said plurality of displaceable regions is facilitated.

15. The shotgun cartridge case of claim 1 wherein said central opening in said base portion includes a first portion adjacent to said end plane having a first width and a second portion adjacent to said inner wall of said base portion having a second width, said second width being greater than said first width.

16. The shotgun cartridge case of claim 15 wherein said second width of said central opening defines an enlarged cylindrical surface in said central opening.

17. The shotgun cartridge case of claim 15 wherein said first portion of said central opening and said second portion of said central opening have substantially the same axial length.

18. A shotgun cartridge comprising a body including a cylindrical wall having an outer surface, an inner surface, a first end and a second end, and a base portion at said first end of said cylindrical wall defining an end plane and having an inner wall, said entire cartridge case comprising a unitary one-piece body of plastic material, said base portion including a central opening adapted to receive a primer, said cartridge including an end closure at said second end of said cylindrical wall, a wad member disposed within said cartridge and spaced from said end closure and said base portion whereby the space between said end closure and said wad member is adapted to receive shot means and the space between said wad member and said base portion is adapted to receive a powder charge, and a plurality of grooves extending axially from said end plane, said plurality of grooves including radial groove means and circumferential groove means defining a plurality of displaceable regions of said base portion defined by both said radial groove means and said circumferential groove means, whereby said plurality of displaceable regions of said base portion are axially displaceable by means of the powder charge gases released by said cartridge.

19. The shotgun cartridge of claim 18 including said primer disposed in said central opening, said primer including an outer surface for contacting the inner surface of said central opening.

20. The shotgun cartridge of claim 18 wherein said central opening in said base portion includes a first portion adjacent to said end plane having a first width and a second portion adjacent to said inner wall of said base portion having a second width, said second width being greater than said first width.

21. The shotgun cartridge of claim 20 including adhesive means disposed within said second portion of said central opening for adhering said primer to said central opening.

22. The shotgun cartridge of claim 21 wherein said second width of said central opening defines an enlarged cylindrical surface in said central opening.

23. The shotgun cartridge of claim 21 wherein said first portion of said central opening and said second portion of said central opening have substantially the same axial length.

* * * * *